US005299696A

United States Patent [19]

Sheng

[11] Patent Number: 5,299,696

[45] Date of Patent: Apr. 5, 1994

[54] STRUCTURE OF CLOTHES POLE

[76] Inventor: Wu M. Sheng, 2 Fl., No. 24, Ming Chuan 1 St., Chu-Wei Li, Taipei Hsien, Taiwan

[21] Appl. No.: 885,594

[22] Filed: May 19, 1992

[51] Int. Cl.[5] ..... A47F 7/00

[52] U.S. Cl. ..... 211/123; 211/118

[58] Field of Search ..... 211/123, 113, 118, 105.3

[56] References Cited

U.S. PATENT DOCUMENTS

| | | | |
|---|---|---|---|
| 550,791 | 12/1895 | Huebel | 211/123 X |
| 2,546,720 | 3/1951 | Brothers | 211/123 X |
| 2,577,860 | 12/1951 | Schoor | 211/123 X |
| 2,643,775 | 6/1953 | Franklin | 211/123 X |
| 3,424,314 | 1/1969 | Cornelsen | 211/123 X |
| 3,435,955 | 4/1969 | Brunette | 211/123 X |
| 4,760,929 | 8/1988 | Fedorchak | 211/123 |
| 4,819,812 | 4/1989 | Demarest | 211/123 X |

*Primary Examiner*—Alvin C. Chin-Shue
*Assistant Examiner*—Sarah Lechok
*Attorney, Agent, or Firm*—Pro-Techtor International

[57] ABSTRACT

A clothes pole structure is described which is formed in sections. Each section is an elongated hollow member having a restricted neck at one end adapted to be received in the opposite end of an adjacent section to form a pole of end to end sections. A pair of locating blocks are located one at either end of the pole. Each block has a central hole for receiving the end of the pole and a hook member for mounting the same, preferably on a chain to a support. A plurality of fixing rings are provided on the pole. Each ring surrounds the pole and mounts a U-shaped, long ear and a short ear mutually spaced on the periphery thereof. The ears open tangentially to the ring so that a hanger hook inserted into the openings of said ears can be secured to the ring by rotating the ring in the direction of the long ear.

2 Claims, 6 Drawing Sheets

STRUCTURE OF CLOTHES POLE

The present invention relates to a structure for a clothes pole, and in particular to an assembled clothes pole which can be divided into sections.

When consumers choose a product, the most important considerations are the function and convenience of this product. For example, a conventional clothes pole is a unitary body, and the major defects are described as follows: (1) It is inconvenient to carry in a cramped space; (2) when one end of the clothes pole is placed on the user's shoulder, the clothes pole may slide from user's shoulder; (3) the clothes hangers on the clothes pole often fall off; (4) if the clothes pole breaks, the user always discards the pole.

SUMMARY OF THE INVENTION

It is the main object of the present invention to provide a clothes pole which can be divided into sections and reassembled so that this clothes pole can be carried easily.

It is another object of the present invention to provide a clothes pole whose ends are inserted respectively into locating blocks which can ride on a support in order to prevent this clothes pole from slipping off.

It is still another object of the present invention to provide a clothes pole which is fitted with a plurality of fixing rings, so that a clothes hanger can be inserted into the fixing ring and retained therein. This can prevent the clothes hanger from falling off the pole.

BRIEF DESCRIPTION OF THE DRAWINGS

For purpose of promoting an understanding of the principles of this invention, reference will be made to the drawings and following description wherein.

DETAILED DESCRIPTION OF THE PREFERRED EMBODIMENT

Figure 1:
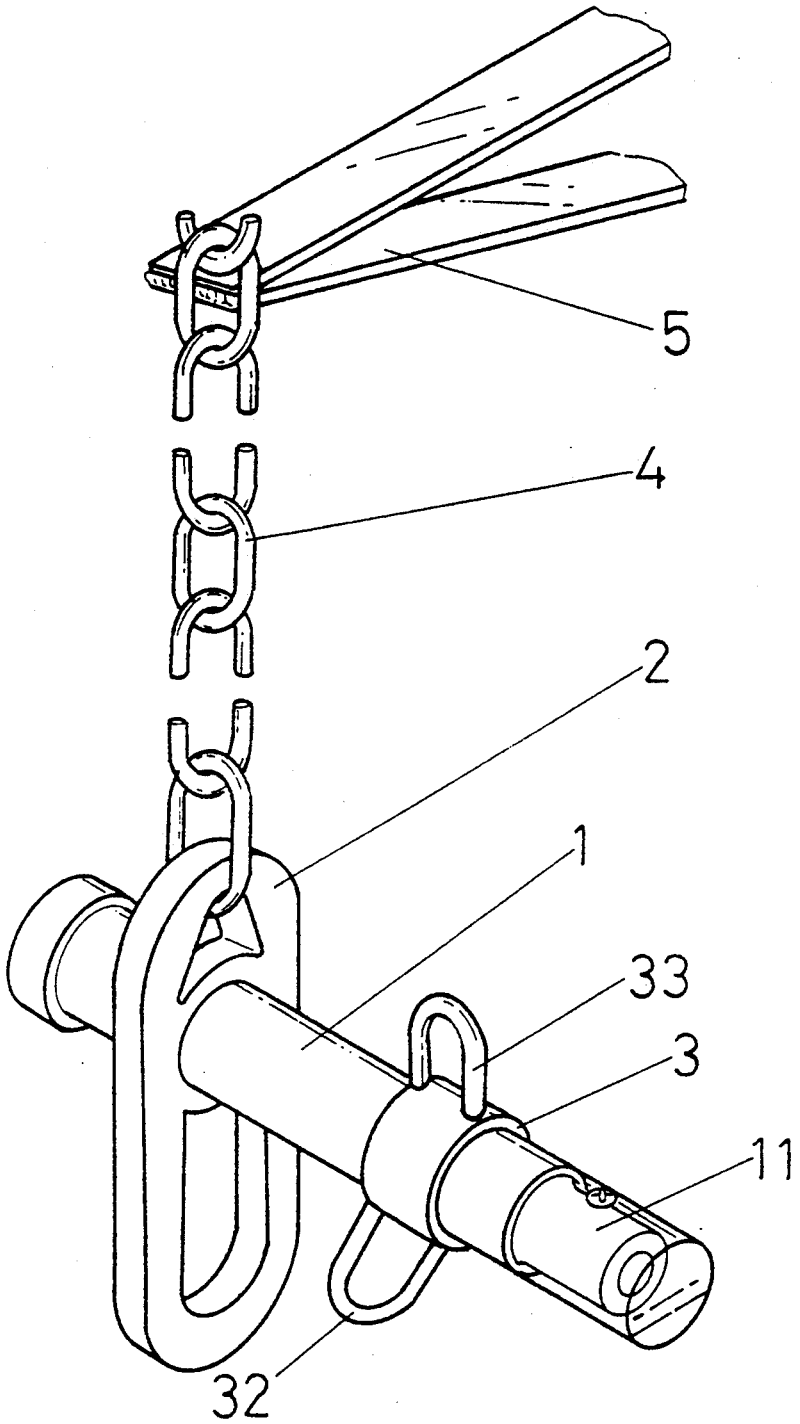
FIG. 1 is a fragmentary perspective view of the present invention.
Figure 2:
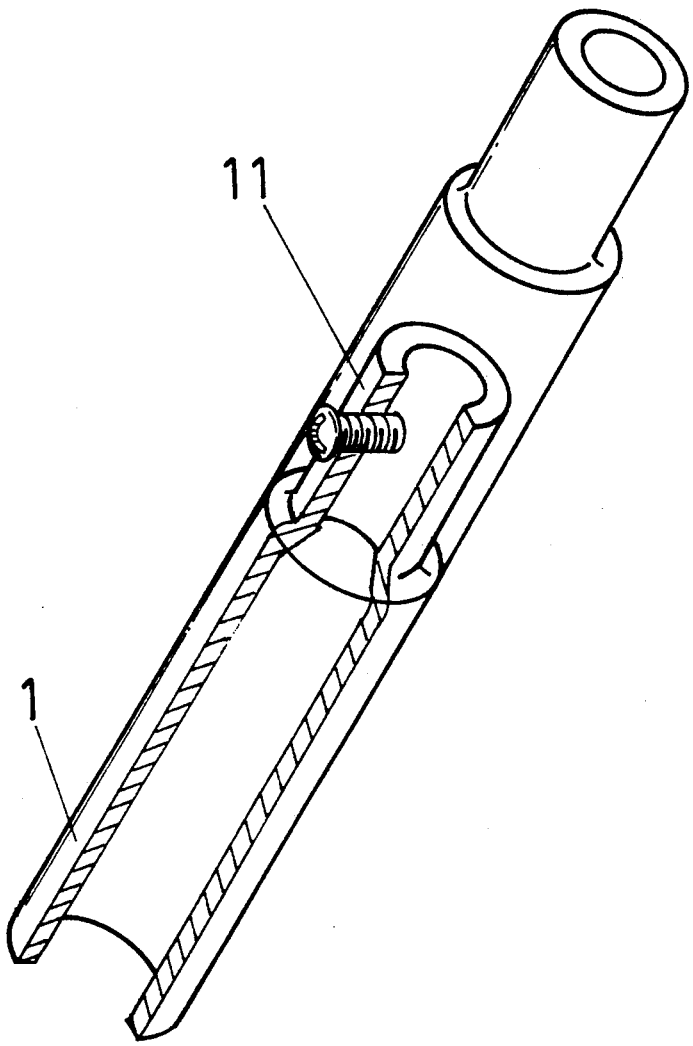
FIG. 2 is a fragmentary perspective view in partial section of the clothes pole of this invention.

Referring to FIG. 1 to FIG. 4, the clothes pole of the present invention comprises a body (1), locating blocks (2), and fixing rings (3), wherein each clothes pole body (1) is hollow, at the one end of each clothes pole body (1) having a neck part (11) which can be inserted into the hollow part of another clothes pole body (1). The neck part (11) of each clothes pole body (1) has an appropriate length which can prevent this part from bending, and accordingly, these clothes pole bodies (1) can be assembled into a clothes pole according to the length of customer's need. The assembled clothes pole is easy to carry and the user can replace a damaged clothes pole body (1) with a new one.

Figure 3:
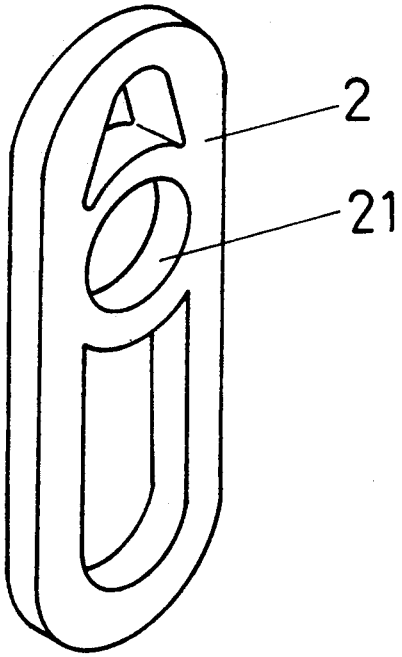
FIG. 3 is a perspective view of the locating block of this invention.
Figure 4:
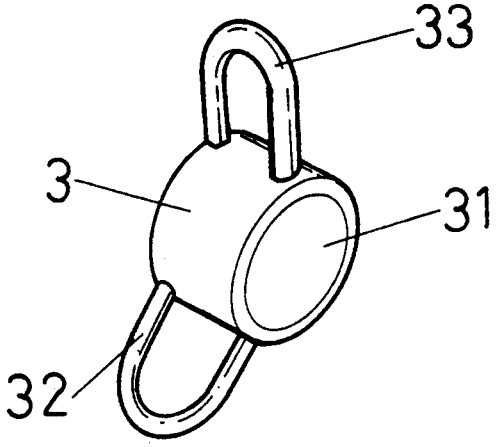
FIG. 4 is a perspective view of the fixing ring of this invention.

The locating blocks (2) shown in FIG. 3, have at the center of each, a hole (21) which is fixed at the two ends of the assembled clothes pole. When taking down the clothes, the locating blocks (2) ride on a support (5) which is fixed on a object so as to prevent the assembled clothes pole from slipping.

Figure 5A:
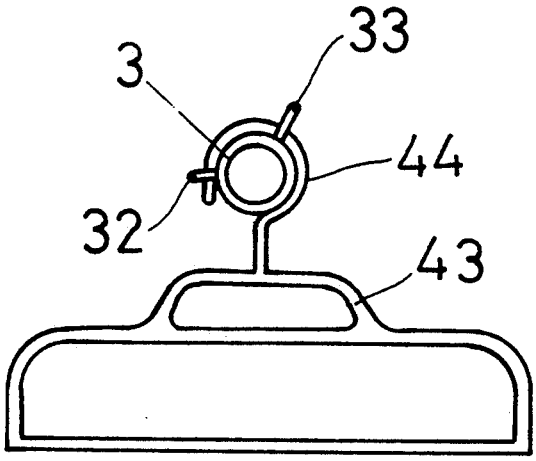
FIGS. 5(A) and (B) are plan views, respectively illustrating the fixing ring and a hanger with the ring rotated in FIG. 5(B) to secure the hanger to the pole.
Figure 5B:
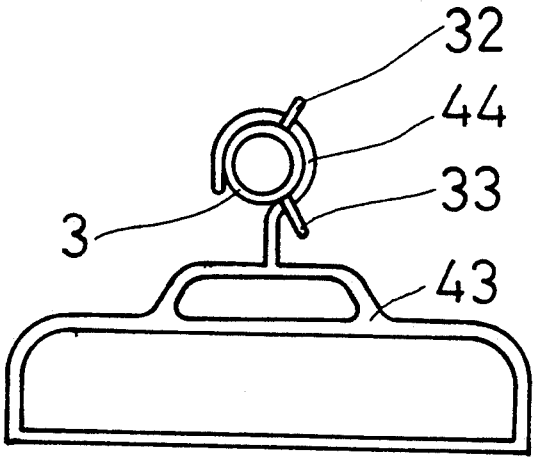

Referring to FIGS. 5 (A) and (B), each fixing ring (3) has a short ear (32) and a long ear (33) at its circumference. Each fixing ring (3) has a fixing hole (31) which slidably mounts the fixing ring (3) on the clothes pole body (1). Each fixing ring (3) receives a clothes hanger (43), after the clothes hanger (43) is inserted into the short ear (32) and long ear (33) of the fixing ring (3) (as shown in FIG. 5(A). The fixing ring (3) is then turned in the direction from the short ear (32) to the long ear (33) to fix the clothes hanger (43), as shown in FIG. 5(B).

Figure 6:
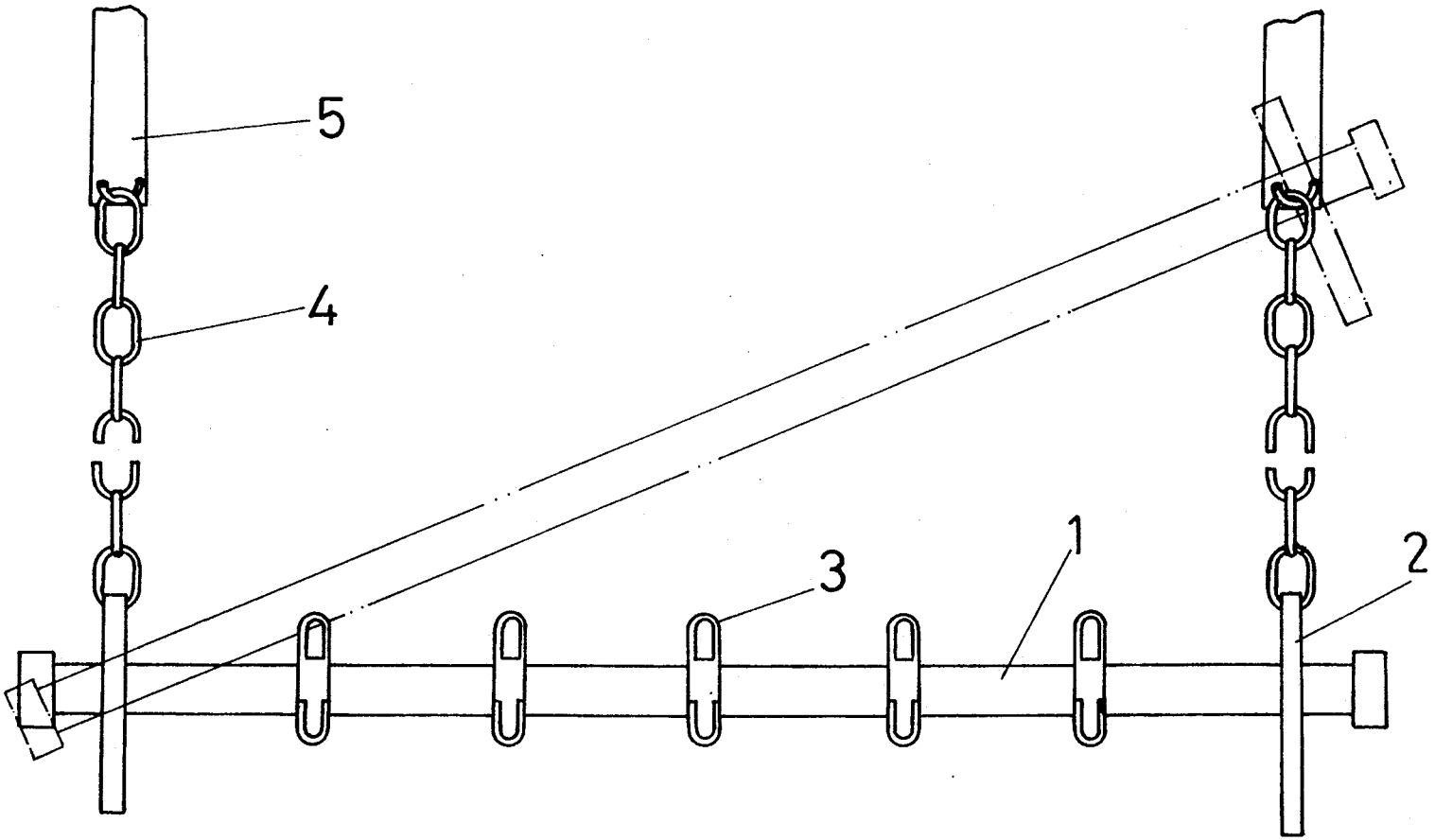
FIG. 6 is a front view of the embodiment of this invention assembled with the disassembled pole shown in phantom.

Referring to FIG. 6 which is the preferred embodiment, the two ends of the assembled clothes pole are fitted respectively with a locating blocks (2) which in turn are connected to an end of a chin (4), and the opposite end of each chain (4) is fixed on a support (5). When taking down the clothes, the user can put down the left end of the assembled clothes pole from the support (5) and made the right locating block (2) ride on the support. Then the assembled clothes pole will slant as shown in phantom in FIG. 6. The assembled means of the locating block (2) so as to prevent the assembled clothes pole from slipping off.

It is understood by those skilled in the art that the foregoing description is a preferred embodiment of the disclosed device and that various changes and modifications may be made in the invention without departing from the spirit and scope thereof.

What is claimed is:

1. A clothes pole comprising:

a plurality of elongated hollow clothes pole bodies, each body having a neck at one end adjusted to be received in the corresponding opposite end of another body to assemble a pole of said bodies in end-to-end configuration;

a pair of locating blocks, one disposed at each end of said pole, each having a central hole there-through for slidably receiving an end of said pole and a hook portion for mounting on a support;

a plurality of fixing rings slidably received on said pole, each ring having a U-shaped, long ear and a short ear mutually spaced on the periphery thereof for receiving a hanger hook and for securing the same to said pole.

2. The clothes pole of claim 1, wherein each ring is coaxially and rotatably mounted on said pole and each U-shaped ear opens tangentially to the periphery of said ring.

* * * * *